United States Patent [19]

Calato

[11] 4,028,983

[45] June 14, 1977

[54] ADJUSTABLE DRUM BRUSH

[76] Inventor: Joseph D. Calato, 8685 Rivershore Drive, Niagara Falls, N.Y. 14304

[22] Filed: Oct. 6, 1975

[21] Appl. No.: 619,670

[52] U.S. Cl. ..... 84/422 S
[51] Int. Cl.[2] ..... G10D 13/00
[58] Field of Search ..... 84/422 S, 422; 15/144 R, 144 B, 172

[56] References Cited

UNITED STATES PATENTS

| | | | |
|---|---|---|---|
| 2,485,822 | 10/1949 | Goldrich | 84/422 S |
| 2,485,823 | 10/1949 | Goldrich | 84/422 S |
| 2,513,930 | 7/1950 | Goldrich | 84/422 S |
| 2,728,257 | 12/1955 | Pochobradsky | 84/422 S |
| 3,150,555 | 9/1964 | Sage | 84/422 S |
| 3,730,570 | 5/1973 | Brochstein | 84/422 S |

*Primary Examiner*—Stephen J. Tomsky
*Attorney, Agent, or Firm*—Ashlan F. Harlan, Jr.

[57] ABSTRACT

A drum brush comprising a casing, a plurality of wire bristles at least partially within said casing and movable to selected positions in which portions of said bristles extend outwardly from one end of said casing, and a control rod operatively connected to said bristles and adapted to move said bristles to and from said selected positions, said casing having an open end through which said bristles may be wholly removed, a cap adhesively held on said open end of said casing having a bore through which said control rod extends and having a groove into which said open end of said casing extends, and crimps in said control rod for holding the bristles in desired position.

15 Claims, 6 Drawing Figures

31
13
11
17
23
27

31
13
11
17
23
27
25

31
15
29
11
23
27
17
25

17
21
19

11
35
23
37

31
5
5
37
33
11
23
35
27
25

ADJUSTABLE DRUM BRUSH

BACKGROUND OF THE INVENTION

The invention of the present application relates to drum brushes, i.e. brush-like devices employed by drummers to obtain a swishing sound from a snare drum, other drums of similar type and/or a cymbal. Since the sound obtained when using a drum brush varies with the spread of the brush, and thus the area of the drum head or cymbal contacted by the brush, it is known to encase such a brush telescopically in a tube, whereby the bristles may be extended and retracted to adjust the amount of protrusion of the bristles and obtain the desired amount of spreading. It is common for the drummer using the brush to bend the stem or handle thereto to provide a stop when the brush is extended the predetermined, desired amount.

Objects of the present invention are to provide a drum brush that is of simple, inexpensive construction, that is so constructed that it may be easily adjusted to the desired spread without distortion of the stem thereof, that retains the desired spread, and that is easy to use.

SUMMARY OF THE INVENTION

The foregoing objects are achieved by the construction hereinafter described and shown in the accompanying drawings. The drum brush proper comprises a packet containing a plurality of stiff but resilient wires clamped at one end in a metal clip or ferrule affixed to the end of a larger, stiffer wire or control rod. The ferrule and the attached ends of the bristles and control rod are encased in a tubular casing, preferably formed of metal. The outer ends of the bristles extend outwardly from one end of the casing and the control rod extends outwardly through a cap fitting and adhesively held on the end of the tube remote from the brush. The lengths of the tube is such that the wire bristles can be retracted into the tube or extended a desired amount. The control rod of the brush is formed with one or more crimps which tend to bind in the cap so that, when adjusted with a crimp in the bore of the cap through which the rod passes, the rod is firmly gripped. In a modification, the cap is provided with a sheath portion of resilient, flexible material, which may be integral with the cap, that covers the casing.

SHORT DESCRIPTION OF THE DRAWINGS

DESCRIPTION OF THE INVENTION

Figures 1, 2, 3, 4, 5, 6:
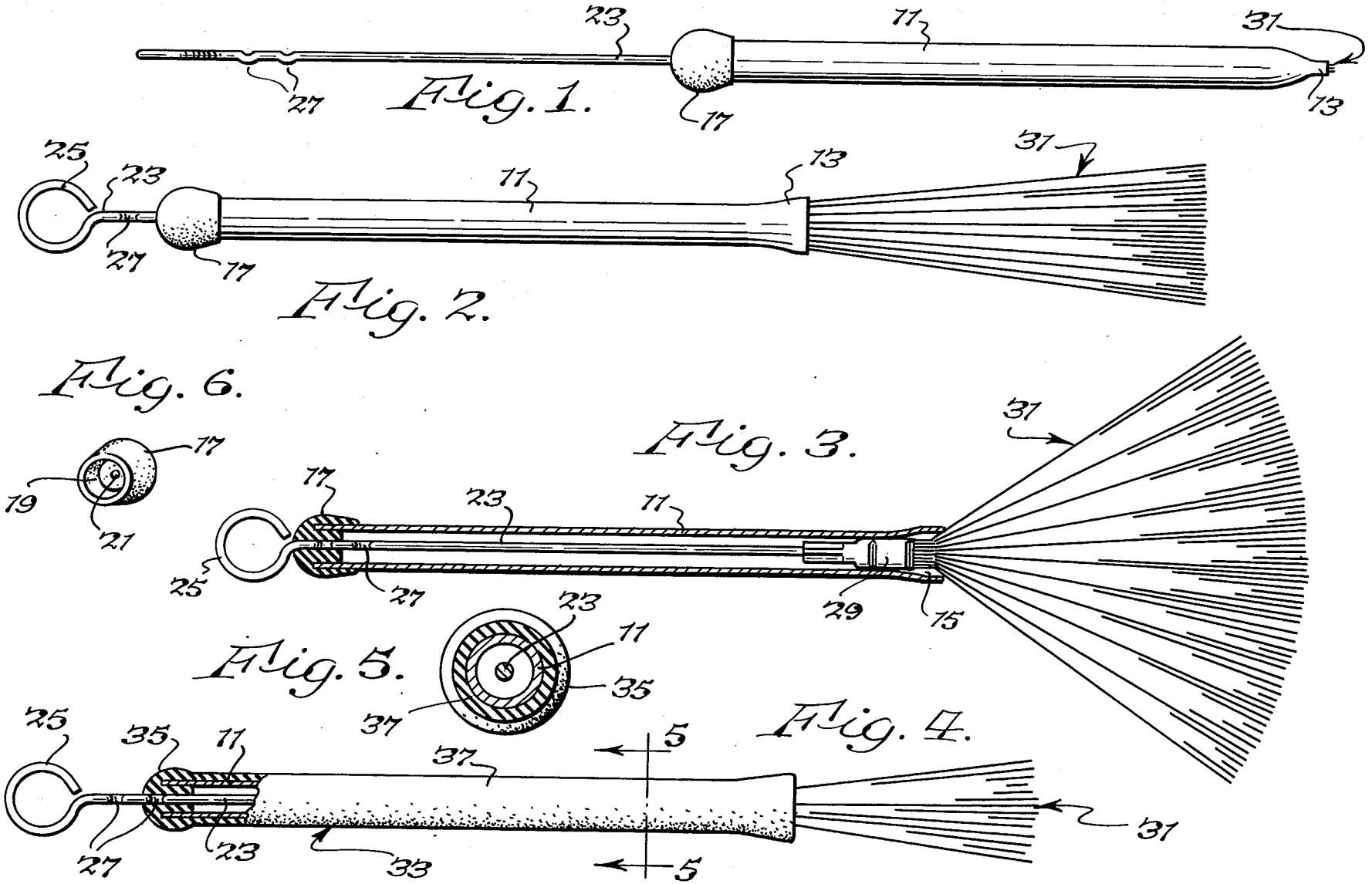
FIG. 1 is a side elevation of the drum brush of the present invention with the bristles of the brush retracted.
FIG. 2 is a plan view of the drum brush shown in FIG. 1 with the brush bristles partially extended.
FIG. 3 is a view of the drum brush shown in FIGS. 1 and 2 with the brush bristles fully extended and the brush casing in section.
FIG. 4 is a plan view, partly in section, similar to FIG. 2, showing a modified cap.
FIG. 5 is a cross section taken on line 5—5 of FIG. 4.
FIG. 6 is a perspective view of the cap shown in FIGS. 1 – 3.

The drum brush is illustrated in FIGS. 1 – 3 comprises a tubular casing 11, which is preferably made of easily formed metal such as aluminum or brass, and is preferably cylindrical except for a flattened portion 13 at one end there of which has a slot-like opening 15 therethrough. The other end of the casing 11 is closed by a cap 17 formed of resilient, flexible material such as rubber which is provided with a groove 19 adapted to receive the end of the casing and a central longitudinal bore 21 through which a control rod 23 extends. Preferably suitable adhesive is employed to firmly secure the cap on the end of the tubular casing 11. The rod 23 on the end thereof passing through the cap 17, is preferably bent into a loop 25 and adjacent to the loop the rod is formed with a plurality of longitudinally spaced crimps 27.

At its other end, within the tubular casing 11, the control rod 23 is attached to a ferrule 29 that is longitudinally movable in the casing. Also carried by the ferrule 29 and projecting from the end thereof opposite the rod 23 is a pack 31 or wire bristles which are stressed adjacent the ferrule so that when unrestrained they tend to fan out as shown in FIG. 3.

It will be evident from the foregoing description and FIGS. 1 – 3 of the drawings how the adjustable drum brush of the present invention functions. When not in use, the wire bristles of the brush are retracted into the casing 11 by pulling the control rod 23 outwardly to the position shown in FIG. 1. By pushing the rod 23 into the casing, to the position shown in FIG. 2, one of the crimps 27 in the rod is firmly engaged within the bore 21 in the cap 17 and the pack of wire bristles is extended outwardly from the other end of the tubular casing 11. As shown in FIG. 3, the control rod 23 may be pushed farther into the casing 11, where the other crimp 27 in the rod is firmly held in the bore 21 of the cap, to cause the wire bristles to be farther exposed and permit them to fan out. Thus the wire bristles can be spread over a larger or smaller area and may be made more or less rigid, depending upon how much they protrude from the casing. It will be understood that the resilient gripping of the crimps 27 in the rod 23 by the cap 17 maintains the wire bristles in adjusted position and that any desired number of crimps may be formed in the rod.

In FIGS. 4 and 5 there is illustrated a modified form of adjustable drum brush comprehended in the present invention. The modified construction differs from that described above only in that the resilient cap 17 of the first described embodiment is elongated into a sheath portion. Thus in the modification, there is provided a combined cap and sheath 33 for the tubular casing 11. The cap portion 35 is identical in internal structure with the cap 17 and firmly grips the control rod 23 where the crimps 27 occur. The sheath portion 37 extends over the casing 11 and prevents contact of the metal of the latter with other objects, thus preventing accidentcal noise and providing a different, and for some users, more satisfactory gripping surface for the drum brush. In use, the action of the embodiment of the invention illustrated in FIGS. 4 and 5 is the same as that of the first-described embodiment.

The casings are preferably fashioned from an easily formable metal such as aluminum or brass; the control rods are preferably steel and the caps or combined caps and sheaths are preferably formed of natural or synthetic rubber although a number of other known flexible, resilient plastics are suitable. The clip or ferrule 29 may be made of a deformable metal or molded of a suitable thermoplastic material. It should securely and rigidly hold both the control rod and the wire bristles.

The wire bristles are preferably made from tempered steel wire although phosphor bronze wire can be used for the purpose. The wire can be of any desired diameter and the length of the bristles may vary as desired.

It will be understood that the size of drum brushes according to the invention may vary as described and the proportions of the parts may differ from those in the illustrations. Other modifications in the illustrated embodiments can also be made without departing from the spirit of the invention. For example, the casing can be formed with a polygonal cross section and/or the cap for the casing can be of different shape and/or, when the combined cap and sheath of FIGS. 4 and 5 is used, the sheath may not completely cover the casing. Accordingly the present invention should not be restricted to the embodiments shown and described, but should be interpreted as broadly as permitted by the accompanying claims.

I claim:

1. In a drum brush comprising a casing, a plurality of wire bristles at least partially within said casing and movable to selected positions in which portions of said bristles extend outwardly from one end of said casing, and a control rod operatively connected to said bristles and adapted to move said bristles to and from said selected positions, the improvements which comprise: said casing having an open end through which said bristles may be wholly removed, and a cap adhesively held on said open end having a bore through which said control rod extends and having a groove into which said open end of said casing extends.

2. A drum brush as defined in claim 1 wherein the free end of said control rod is provided with a loop.

3. A drum brush as defined in claim 1 wherein said control rod is crimped adjacent the free end thereof whereby to increase friction of said rod in said bore.

4. A drum brush as defined in claim 3 wherein there are a plurality of spaced crimps in said rod.

5. A drum brush as defined in claim 2 wherein said control rod is crimped adjacent the free end thereof whereby to increase friction of said rod in said bore.

6. A drum brush as defined in claim 5 wherein there are a plurality of spaced crimps in said rod.

7. A drum brush as defined in claim 1 wherein said cap has a flexible, resilient sheath extending therefrom and covering said casing.

8. A drum brush as defined in claim 2 wherein said cap has a flexible, resilient sheath extending therefrom and covering said casing.

9. A drum brush as defined in claim 3 wherein said cap has a flexible, resilient sheath extending therefrom and covering said casing.

10. A drum brush as defined in claim 4 wherein said cap has a flexible, resilient sheath extending therefrom and covering said casing.

11. A drum brush as defined in claim 5 wherein said cap has a flexible, resilient sheath extending therefrom and covering said casing.

12. A drum brush as defined in claim 6 wherein said cap has a flexible, resilient sheath extending therefrom and covering said casing.

13. A drum brush as defined in claim 1 in which said cap is flexible and resilient.

14. A drum brush as defined in claim 12 in which said cap is flexible and resilient.

15. In a drum brush comprising a casing, a plurality of wire bristles at least partially within said casing and movable to selected positions in which portions of said bristles extend outwardly from one end of said casing, and a control rod operatively connected to said bristles and adapted to move said bristles to and from said selected positions, the improvements which comprise: said casing having an open end through which said bristles may be wholly removed, and a cap slidably mounted on said open end of said casing having a bore through which said control rod extends and having an internal annular groove into which said open end of said casing extends.

* * * * *